US005788226A

United States Patent [19]

Peglow

[11] Patent Number: 5,788,226

[45] Date of Patent: Aug. 4, 1998

[54] RIBBON GATHERING AND FORMING ASSEMBLY

[75] Inventor: Craig J. Peglow, Brookfield, Wis.

[73] Assignee: Quad/Tech, Inc., Sussex, Wis.

[21] Appl. No.: 659,332

[22] Filed: Jun. 6, 1996

[51] Int. Cl.[6] ..... B41L 1/30

[52] U.S. Cl. ..... 270/40; 270/41

[58] Field of Search ..... 270/40, 41, 52.07

[56] References Cited

U.S. PATENT DOCUMENTS

| | | |
|---|---|---|
| 2,027,412 | 1/1936 | Zuckerman . |
| 2,143,247 | 1/1939 | Seaman et al. . |
| 2,463,769 | 3/1949 | Higgins . |
| 2,495,909 | 1/1950 | Ross . |
| 4,509,733 | 4/1985 | Pflaum et al. . |
| 4,925,170 | 5/1990 | Weis . |
| 4,939,888 | 7/1990 | Katz et al. . |
| 5,048,810 | 9/1991 | Palmatier et al. . |

*Primary Examiner*—Hoang Nguyen
*Attorney, Agent, or Firm*—Michael, Best & Friedrich

[57] ABSTRACT

A ribbon gathering and folding assembly including a plurality of guide rollers positioned in superimposed relation to each other, the guide rollers being adapted to guide a ribbon, and a ribbon former including a former board that is positioned to receive ribbons from the guide rollers. The former board has a longitudinally extending forming surface that is positioned such that a direction of each ribbon travelling between the guide rollers and the former board is always within about 35 degrees of the forming surface. The ribbon former further includes a former roller positioned to guide the ribbons travelling from the guide rollers to the former board, and preferably also a control roller positioned between the former roller and the guide rollers on an opposite side of the ribbons from the former roller. A coating device is positioned to coat a low friction substance (e.g., silicone) onto a the upper surface of the upper-most ribbon and another coating device coats the lower surface of the lower-most ribbon.

20 Claims, 2 Drawing Sheets

RIBBON GATHERING AND FORMING ASSEMBLY

FIELD OF THE INVENTION

The present invention generally relates to the field of print production and, more specifically, to the field of ribbon gatherers that gather a plurality of ribbons in preparation for delivery to a ribbon former, where folding and cutting operations are performed.

BACKGROUND OF THE INVENTION

In the production of print media, it is common to simultaneously print multiple pages on a moving web of paper. For example, a typical printed web for producing a magazine can be wide enough to accommodate six sheets, corresponding with twelve printed pages (i.e., one page on each side of each sheet). After printing, the web is slit longitudinally (i.e., in the direction of travel) into a plurality of ribbons. Typically, each ribbon includes a pair of side-by-side sheets, corresponding with four printed pages. The pair of sheets will be folded along a central longitudinal border between the sheets to form a book. Webs that are six sheets wide will thus be slit into three ribbons.

The ribbons are gathered on top of each other by a ribbon gathering and forming assembly, such as the Stack Pull Roll Section made by Heidelberg-Harris, Inc. of Dover, N.H., shown in FIG. 1. The illustrated assembly 10 includes a ribbon gatherer 12, a front ribbon former 14 and a rear ribbon former 16. The ribbon gatherer 12 includes a support structure 18 that can simultaneously accommodate up to eight ribbons 20 (e.g., from more than one web), which are provided to the ribbon gatherer 12 in vertically-superimposed relation to each other. Each ribbon 20 enters its own receiving nip formed by a guide roller 22 and a nip roller 24 supported by a mount 26. The guide rollers 22 are positioned in superimposed relation to each other. The ribbons are pulled by the guide rollers 22 and travel down toward front and rear gathering rollers 28, 30 where the ribbons 20 are gathered together in stacked relation. It can be seen that the ribbons 20 stay separated from each other until they reach the gathering rollers 28, 30. In the illustrated embodiment, four of the ribbons 20 go to the front gathering roller 28 and the other four ribbons 20 go to the rear gathering roller 30. However, any or all of the ribbons 20 could go to the front or rear gathering rollers 28, 30.

The ribbons 20 travel around the gathering rollers 28, 30 and toward the front and rear ribbon formers 14, 16 where the gathered ribbons 20 are folded and cut into individual books in a conventional manner. The front and rear ribbon formers 14, 16 include front and rear former rollers 32, 34, front and rear pinch rollers 36, 38 and front and rear former boards 40, 42 having front and rear forming surfaces 44, 46. By simultaneously using the front and rear ribbon formers 14, 16, two separate books can be produced using the same assembly 10.

While the above-described ribbon gatherer and ribbon formers work adequately, there is a need to improve their reliability and speed.

SUMMARY OF THE INVENTION

The speed of operation of ribbon gatherers and ribbon formers is limited in part by the ability to control the ribbons at high speed. Loss of control can result in smearing of the print, wrinkling of the ribbons, or loss of proper positioning of the ribbon resulting in incorrect fold or cutter location.

The present invention recognizes that loss of ribbon control is partially due to the gathering of ribbons in superimposed contacting relation and the subsequent passing of the contacted ribbons through several changes of direction before the ribbon former. More specifically, the present invention realizes that improved ribbon control is achieved when the amount of directional variation of the contacting ribbons is reduced. The present invention solves the above-noted problem by maintaining the ribbons separated until immediately before the ribbon former, and by limiting the directional change of the ribbons after the ribbons have been gathered into contacting relation with each other.

In one aspect, the present invention provides a ribbon gathering and folding assembly including a plurality of guide rollers positioned in superimposed relation to each other, the guide rollers being adapted to guide a ribbon, and a ribbon former including a former board that is positioned to receive ribbons from the guide rollers. The former board has a longitudinally extending forming surface that is positioned such that a direction of each ribbon travelling between the guide rollers and the former board is always within about 35 degrees of the forming surface. Preferably, such direction is always within about 25 degrees, and more preferably about 20 degrees, of the forming surface.

In one embodiment, the ribbon former further includes a former roller positioned to guide the ribbons travelling from the guide rollers to the former board, and preferably also a control roller positioned between the former roller and the guide rollers on an opposite side of the ribbons from the former roller. A coating device can be positioned to coat a low friction substance (e.g., silicone) onto at least one of the ribbons prior to contact of the ribbon with the former board. Preferably, a coating device coats the upper surface of the upper-most ribbon and another coating device coats the lower surface of the lower-most ribbon. A ribbon slitter can be positioned to slit a ribbon travelling over the guide roller.

The present invention also provides a method of modifying a ribbon gathering and folding assembly having a support structure, a plurality of rear guide rollers, a front gathering roller, a front ribbon former positioned to receive ribbons from the front gathering roller, a rear gathering roller, and a rear ribbon former positioned to receive ribbons from the rear gathering roller. The method includes the steps of securing (e.g., bolting) an auxiliary gathering device to the support structure above the front ribbon former, the auxiliary gathering device including a plurality of front guide rollers, and passing a plurality of ribbons through the rear guide rollers, through the front guide rollers, and to the front ribbon former without passing the plurality of ribbons over the front gathering roller.

In one embodiment, the method further includes the step of positioning a coating device between the rear guide rollers and the front ribbon former, the coating device being adapted to coat a surface of a ribbon with a low friction substance. In another embodiment, the front ribbon former includes a front former board having a forming surface that is positioned to receive ribbons from the front guide rollers, and the method further includes the step of positioning the front guide rollers such that a direction of each ribbon travelling between the front rollers and the front former board is always within 35 degrees of the forming surface.

The present invention further provides a ribbon gatherer including a plurality of guide rollers positioned in superimposed relation with each other, and a coating device positioned to receive a ribbon and to coat one surface of the ribbon with a low friction substance. Preferably, the coating device is positioned to coat an upper surface of an upper-most ribbon and/or a lower surface of a lower-most ribbon. A slitter can be positioned to slit at least one of the ribbons, and preferably is positioned to slit each ribbon except an upper-most ribbon and a lower-most ribbon.

DETAILED DESCRIPTION

Figure 1:
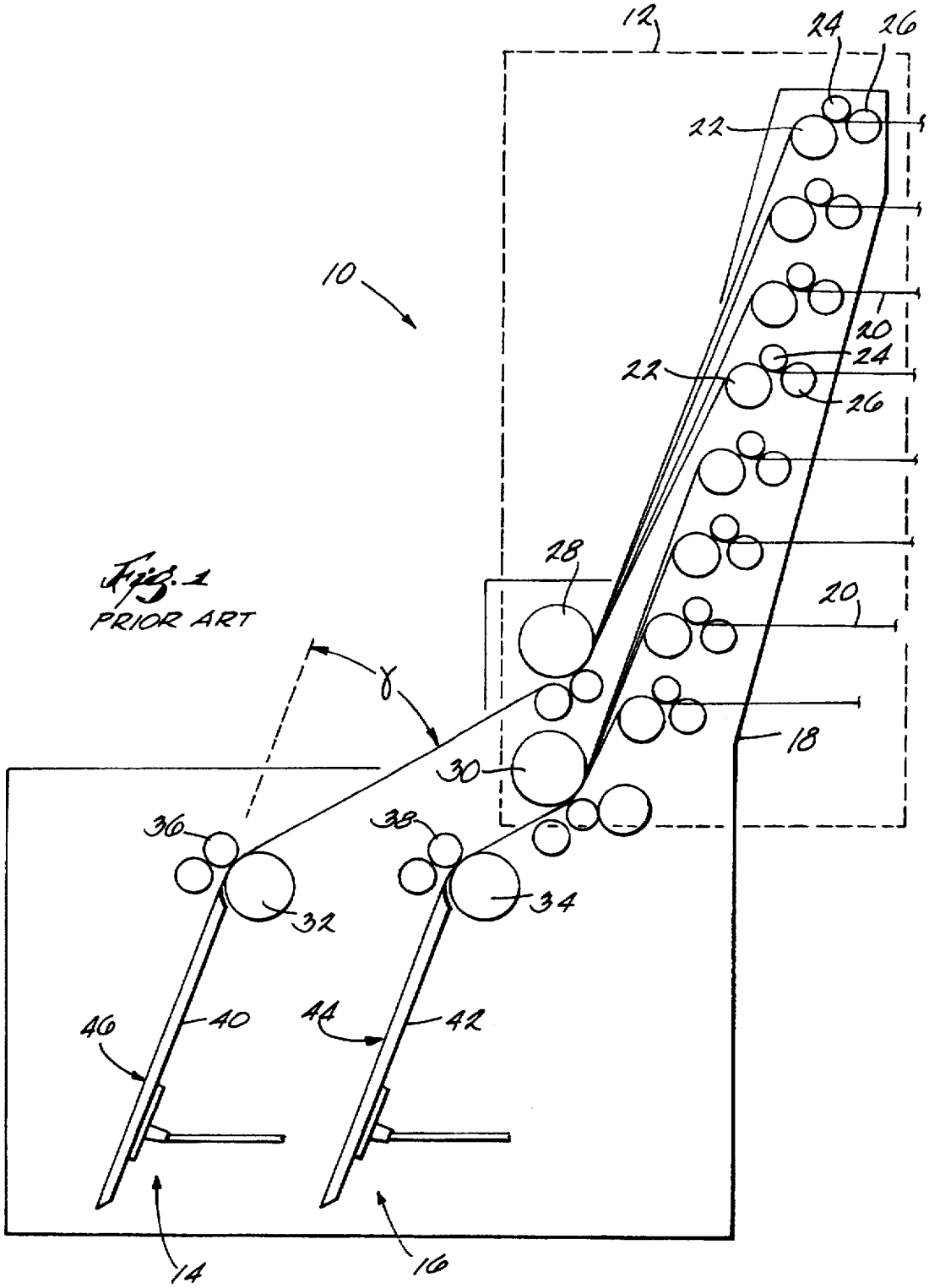
Fig. 1 PRIOR ART
FIG. 1 is a side view of a prior art ribbon gathering and forming assembly.
Figure 2:
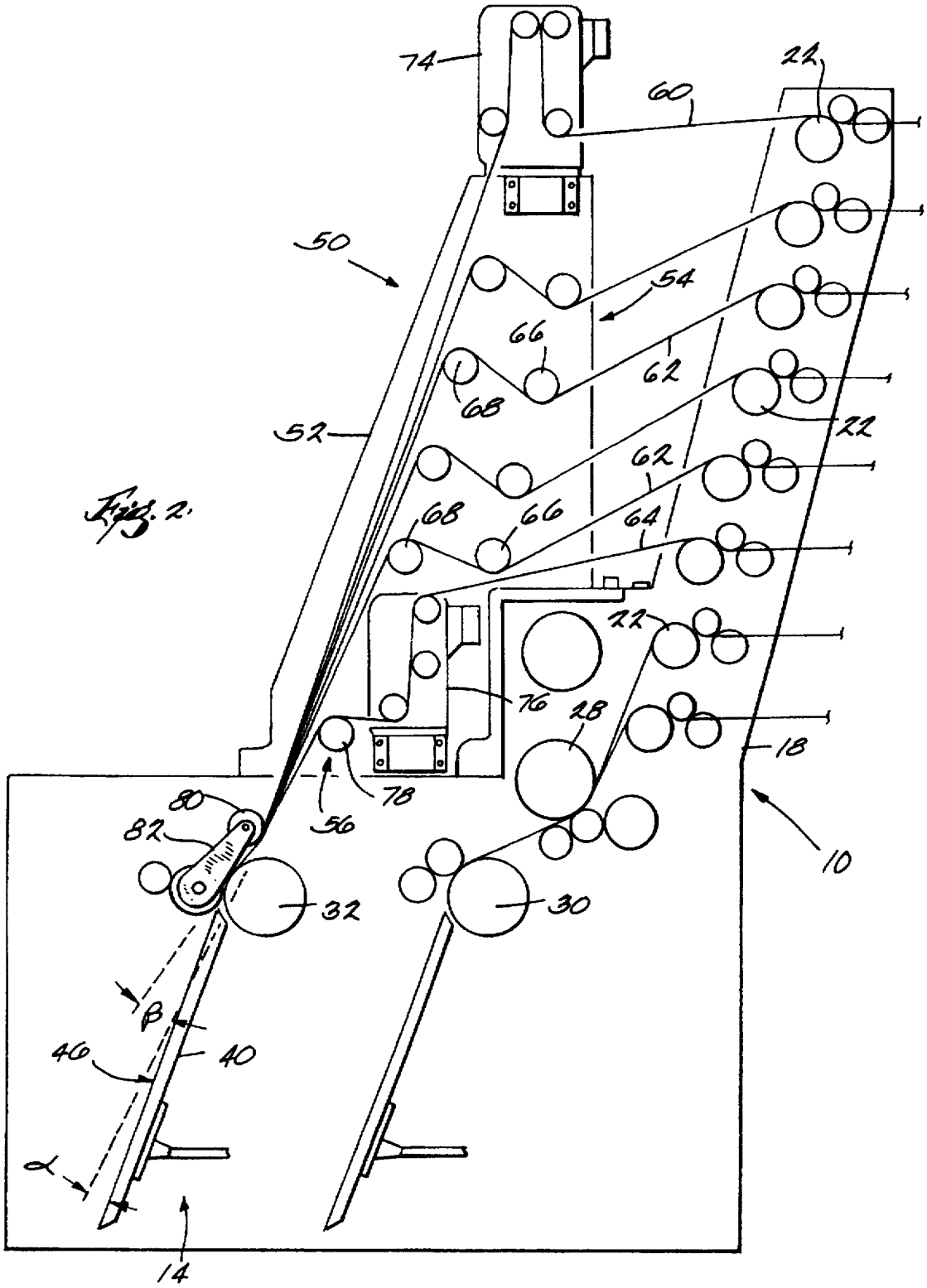
FIG. 2 is a side view of a ribbon gathering and forming assembly embodying the present invention.

FIG. 2 illustrates the standard ribbon gathering and forming assembly 10 of FIG. 1 with an auxiliary ribbon gatherer 50 secured thereto. The auxiliary ribbon gatherer 50 includes a support frame 52 that is bolted to the support structure 18 above the front ribbon former 14. The auxiliary ribbon gatherer 50 is designed to receive ribbons from the rear guide rollers 22 and provide the ribbons to the front ribbon former 14. In this regard, the support frame 52 is open at a rear portion 54 to allow ribbons to enter from the rear guide rollers 22, and is also open at a bottom portion 56 to allow delivery of the ribbons to the front ribbon former 14. The illustrated auxiliary ribbon gatherer 50 is designed to accommodate six ribbons: an upper-most ribbon 60, four medial ribbons 62, and a lower-most ribbon 64. However, it should be appreciated that the auxiliary ribbon gatherer 50 of the present invention could be made to accommodate other numbers of ribbons.

The auxiliary ribbon gatherer 50 includes four intermediate rollers 66 and four corresponding front guide rollers 68 that are rotatably mounted to the support frame 52. The intermediate rollers 66 receive the medial ribbons 62 from the rear guide rollers 22, and the front guide rollers 68 provide the medial ribbons 62 to the front ribbon former 14. The front former board 40 includes a forming surface 46. The front guide rollers 68 are positioned such that the medial ribbons 62 leave the front guide rollers 68 at an angle $\alpha$ that is less than about 35 degrees relative to the forming surface of the front former board 40. In the illustrated embodiment, the maximum angle $\alpha$ of the medial ribbons 62 as they leave the front guide rollers 68 is less than about 5 degrees relative to the forming surface 46 of the front former board 40.

The four front guide rollers 68 each include a corresponding slitter device for allowing slitting of the four medial ribbons 62. The slitter devices are positioned adjacent to the front guide rollers 68, and can be adjusted between engaged and disengaged positions so the four medial ribbons 62 can be selectively slit if desired.

The auxiliary ribbon gatherer 50 further includes an upper coating device 74 and a lower coating device 76. The upper coating device 74 is secured to the support frame 52 above the front guide rollers 68, and is positioned to receive the upper-most ribbon 60 from the corresponding rear guide roller 22 and deliver the upper-most ribbon 60 to the front ribbon former 14. The lower coating device 76 is secured to the support frame 52 below the front guide rollers 68, and is positioned to receive the lower-most ribbon 64 from the corresponding rear guide roller 22 and deliver the lower-most ribbon 64 to the front ribbon former 14 via an idler roller 78. The upper and lower coating devices 74, 76 are designed to coat the upper surface of the upper-most ribbon 60 and the lower surface of the lower-most ribbon 64, respectively, with a low friction substance. The low friction substance alleviates smearing of the print during subsequent handling (e.g., during folding and cutting at the ribbon former). In the illustrated embodiment, the low friction substance is silicone, and the upper and lower coating devices 74, 76 are Silicone Coaters, available from Quad/Tech, Inc. of Pewaukee, Wis.

When mounting the illustrated auxiliary ribbon gatherer 50 to the standard assembly 10, the front pinch roller 36 is removed and replaced by a control roller 80 mounted on a pivoting arm 82 and positioned between the front former roller 32 and the front guide rollers 68. The control roller 80 is positioned on the opposite side of the ribbons from the front former roller 32, and prevents air from becoming entrapped between the ribbons by limiting the outward (i.e., to the left, in FIG. 2) movement of the ribbons. The pivoting arm 82 is pivotally adjustable to accommodate a variety of ribbon thicknesses and web speeds.

The positioning of the control roller 80 relative to the front guide rollers 68 and the front former roller 32 is such that a maximum angle $\beta$ of each ribbon travelling between the front guide rollers 68 and the front former board 40 is always within about 35 degrees of the forming surface 46 of the front former board 40. Preferably, the maximum angle $\beta$ of the ribbons is always within about 25 degrees, and more preferably 20 degrees, of the forming surface 46. In the illustrated embodiment, the angle $\beta$ of the ribbons within about 17 degrees of the forming surface 46.

In contrast, referring to FIG. 1, it is noted that the front and rear gathering rollers 28, 30 and the front and rear former rollers 32, 34 of the standard assembly 10 put the ribbons through an angle $\gamma$ of more than 40 degrees relative to the forming surface after contacting the gathering rollers 28, 30, and before entering the corresponding front and rear former boards 40, 42. It is this difference between the directional changes that is believed to provide greater control of the ribbons, corresponding with less damaged product, more accurate folding, more accurate cutting, and/or faster web speeds.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A ribbon gathering and folding assembly comprising:

a plurality of guide rollers positioned in superimposed relation to each other, each guide roller adapted to guide a ribbon; and a ribbon former including a former board that is positioned to receive ribbons from said guide rollers, wherein ribbons travelling between said guide rollers and said former board travel in a direction, wherein said former board includes a longitudinally-extending forming surface that is positioned such that the direction of each ribbon travelling between said guide rollers and said former board is always within about 35 degrees of said forming surface.

2. An assembly as claimed in claim 1, wherein said ribbon former further includes a former roller positioned to guide the ribbons travelling from said guide rollers to said former board.

3. An assembly as claimed in claim 2, wherein said ribbon former further includes a control roller positioned between said former roller and said guide rollers on an opposite side of the ribbons from said former roller.

4. An assembly as claimed in claim 1, further comprising at least one coating device positioned to coat a low friction substance onto at least one of the ribbons prior to contact of the ribbon with said former board.

5. An assembly as claimed in claim 4, wherein said coating device includes a silicone coater.

6. An assembly as claimed in claim 5, wherein said silicone coater is positioned to coat silicone on at least one of an upper surface of an upper-most ribbon and a lower surface of a lower-most ribbon.

7. An assembly as claimed in claim 1, further comprising a ribbon slitter positioned to slit a ribbon travelling over said guide roller.

8. An assembly as claimed in claim 1, wherein the direction of each ribbon travelling between said guide rollers and said former board is always within about 25 degrees of said forming surface.

9. An assembly as claimed in claim 1, wherein the direction of each ribbon travelling between said guide rollers and said former board is always within about 20 degrees of said forming surface.

10. A method of modifying a ribbon gathering and folding assembly having a support structure, a plurality of rear guide rollers rotatably mounted relative to the support structure, a front gathering roller rotatably mounted relative to the support structure, a front ribbon former positioned to receive ribbons from the front gathering roller, a rear gathering roller rotatably mounted relative to the support structure, and a rear ribbon former positioned to receive ribbons from the rear gathering roller, said method comprising the steps of:

securing an auxiliary gathering device to the support structure above the front ribbon former, the auxiliary gathering device including a plurality of front guide rollers; and passing a plurality of ribbons through the rear guide rollers, through the front guide rollers, and to the front ribbon former without passing the plurality of ribbons over the front gathering roller.

11. A method as claimed in claim 10, wherein said step of securing includes bolting.

12. A method as claimed in claim 10, further comprising the step of positioning a coating device between the rear guide rollers and the front ribbon former, the coating device being adapted to coat a surface of a ribbon with a low friction substance.

13. A method as claimed in claim 10, wherein the front ribbon former includes a front former board positioned to receive ribbons from the front guide rollers and having a longitudinally extending forming surface, said method further comprising the step of positioning the front guide rollers such that a direction of each ribbon travelling between the front rollers and the front former board is always within about 35 degrees of the forming surface.

14. A ribbon gathering and folding assembly comprising:

a support structure;

a plurality of rear guide rollers rotatably mounted relative to said support structure and positioned in superimposed relation to each other, said rear guide rollers adapted to guide a ribbon; and a rear gathering roller rotatably mounted relative to said support structure and positioned to receive ribbons from said rear guide rollers;

a rear ribbon former positioned to receive ribbons from said rear gathering roller, a plurality of front guide rollers rotatably mounted relative to said support structure and positioned in superimposed relation to each other, said front guide rollers being adapted to receive ribbons from said rear guide rollers; and a front ribbon former positioned to receive ribbons from said front gathering roller, wherein ribbons supplied to said rear guide rollers can travel either to said rear gathering roller or to said front guide rollers.

15. An assembly method as claimed in claim 14, wherein said front ribbon former includes a former board having a longitudinally-extending forming surface, wherein ribbons travelling between said front guide rollers and said front former board travel in a direction, wherein said forming surface is positioned such that the direction of each ribbon travelling between said front guide rollers and said front former board is always within about 35 degrees of said forming surface.

16. A ribbon gatherer comprising:

a support structure;

a plurality of guide rollers rotatably mounted to said support structure and positioned in superimposed relation with each other, each guide roller adapted to receive a ribbon;

a coating device mounted to said support structure and positioned to coat one surface of a ribbon with a substance; and a low friction material positioned in said coating device for application onto the ribbon.

17. A ribbon gatherer as claimed in claim 16, wherein said coating device is positioned to coat an upper surface of an upper-most ribbon.

18. A ribbon gatherer as claimed in claim 17, further comprising another coating device positioned to coat a lower surface of a lower-most ribbon.

19. A ribbon gatherer as claimed in claim 16, further comprising a slitter positioned to slit at least one of the ribbons.

20. A ribbon gatherer as claimed in claim 16, further comprising a plurality of slitters positioned to slit each ribbon except an upper-most ribbon and a lower-most ribbon.

* * * * *